United States Patent [19]

Boichu et al.

[11] Patent Number: 4,512,708

[45] Date of Patent: Apr. 23, 1985

[54] EARTH-MOVING MACHINE WITH BOOM, DIPPERSTICK AND BUCKET, EQUIPPED WITH MEANS FOR DIRECTIONALLY-ADJUSTING THE BUCKET

[75] Inventors: Claude P. Boichu, Nogent-sur-Oise; Victor Yeou, Meaux, both of France

[73] Assignee: Poclain, Le Plesses-Belleville, France

[21] Appl. No.: 494,433

[22] Filed: May 10, 1983

[30] Foreign Application Priority Data

May 26, 1982 [FR] France ..... 82 09166

[51] Int. Cl.[3] ..... E02F 3/42

[52] U.S. Cl. ..... 414/694; 414/700; 414/708

[58] Field of Search ..... 414/685, 694, 699, 700, 414/706, 708; 91/31–33, 520, 531; 60/484, 486

[56] References Cited

U.S. PATENT DOCUMENTS

| | | | |
|---|---|---|---|
| 3,133,653 | 5/1964 | Anderson | 414/700 |
| 3,695,474 | 10/1972 | Blakely | 414/708 |
| 4,376,612 | 3/1983 | Yeou | 414/694 |
| 4,408,518 | 10/1983 | Diel et al. | 91/31 |

FOREIGN PATENT DOCUMENTS

| | | | |
|---|---|---|---|
| 2545151 | 4/1976 | Fed. Rep. of Germany | 414/700 |
| 2819256 | 11/1979 | Fed. Rep. of Germany | 414/700 |

*Primary Examiner*—Terrance L. Siemens

*Attorney, Agent, or Firm*—Mason, Fenwick & Lawrence

[57] ABSTRACT

An earth moving machine having a boom, a dipperstick, and a bucket all mounted for pivotal movement one with respect to the other, a double acting cylinder for each of the boom, the dipperstick, and the bucket, respectively, for controlling the pivotal movement of the bucket, for raising and lowering the boom, and for extended and retracting the dipperstick.

9 Claims, 3 Drawing Figures

EARTH-MOVING MACHINE WITH BOOM, DIPPERSTICK AND BUCKET, EQUIPPED WITH MEANS FOR DIRECTIONALLY-ADJUSTING THE BUCKET

Loading machines are already known, which comprise, all mounted for pivoting one with respect to the other, a boom, a dipperstick and a bucket, as well as operating cylinders to adjust the relative position of these different elements.

The angle at which the bucket penetrates into the ground, during the loading phase, should remain substantially constant. To this effect, the bucket operating cylinder is often fixed between said bucket and the boom, thus constituting with said boom, the dipperstick and the bucket, a deformable quadrilateral which is preferably adjusted to form a deformable parallelogram. Then it is possible only by acting on the dipperstick operating cylinder, and having correctly positioned the bucket beforehand, to keep the orientation of said bucket constant.

This technique however, presents certain disadvantages, amongst which a certain complexity: the deflection of the bucket being kinematically linked to that of the dipperstick, the retraction of said stick causes a movement which "closes" the bucket, which bucket is then stopped in its movement, and from that moment causes a blocking of all the movements of the stick and of the bucket, hence the need to provide means for neutralizing the bucket operating cylinder, such as hydraulic means for example, which complicates the control circuit;

a bad design of the emptying part of the bucket, especially when the working equipment is of low capacity;

the necessity to choose large size bucket operating cylinders, which are not standardized, are heavy and expensive;

and the fact that these large operating cylinders are also difficult to protect efficiently by the dipperstick, and as a result that they risk being damaged.

It is the object of the present invention to overcome these disadvantages by providing a new earth-moving machine of the loading type, wherein a three position boom control valve, a three position dipperstick control valve, and a three position bucket control valve are provided for raising and lowering the boom, extending and retracting the dipperstick, and moving the bucket to filling and emptying positions.

In this new machine, the bucket main control valve is provided with second means to adjust its position said means being adapted to place said control valve in its third position automatically from its second position, and being to this effect connected to a source of power by a control connection, whereas an auxiliary control valve assembly with at least two positions, is interposed on said control connection, ensures its continuity on either of its sides in its first position, breaks off said connection in its other positions, and is placed in its first position solely when the boom and stick main control valves are in their third and first positions respectively, and whereas, in the first position of said auxiliary control valve assembly, the second means for adjusting the position of the bucket control valve, effectively connected with the source of power, places said bucket main control valve in its third position.

The following advantageous dispositions are also preferably adopted:

a dividing member or member to limit the orientation of the bucket, is placed on said control connection, comprises two positions, in the first one of which it causes the two parts of said control connection connected thereto, to communicate, and in the second position of which, it isolates said two parts, and is provided with means to adjust its position, which means are associated to a detector of the relative position of the bucket with respect to a predetermined direction, and to a switch, connected to said detector and designed to control the said means provided to adjust the position of the bucket orientation-limiting member, in order to place said limiting member in its second position, when the detected orientation of the bucket exceeds a preset value thereof;

the source of power associated to the bucket main control valve is a source of pressurized fluid, whereas a fluid excess pipe connects the discharge pipe of the member provided to adjust the relative pivoting movement of the bucket with a nonpressurized reservoir, and whereas a restriction and a cut-off valve, also called fluid-return valve, are placed on said excess fluid pipe, said cut-off valve:

having two positions, one in which it causes the two parts of said excess fluid pipe connected thereto, to communicate, and the other in which it closes off said communication, being equipped with means to adjust its position, which means are connected in parallel to said source of power to which is connected the said second means to adjust the position of the bucket main distributor, and, being placed, in its first position, when said second adjusting means are effectively connected with said source of power, and, in its second position, when said second adjusting means are isolated from said source of power;

said machine comprises a shuttle valve with two inlet connections and one outlet connection, whereas the first and second means provided to adjust the position of the bucket main control valve are constituted by a single fluid cylinder connected by way of a pipe to said outlet connection, a spontaneous control pipe connecting one of said inlet connection with a three-position bucket control valve, said three positions corresponding to the three positions of the bucket main control valve, said bucket control valve being itself connected with a source of fluid under pressure, and, an automatic control pipe connecting the other of said inlet connection of the shuttle valve with the said source of power to which is connected the second means to adjust the position of the bucket main control valve, this last source of power being also a source of fluid under pressure;

the detector of the relative orientation of the bucket with respect to a predetermined direction is an assembly constituted by a support and a horizontality sensor fitted on said support and comprising an enclosure containing a substantially freely movable member, and, a proximity sensor, also fitted on the support, adjacent to a wall defining said enclosure and capable of detecting the proximity of the body to said proximity sensor, and then, of changing the state of an electric circuit in which it is integrated, and which passes from one of the ON- or OFF-states to a complementary OFF or ON state;

the substantially freely movable body is a metal ball, preferably a steel ball;

the enclosure also contains a viscous liquid, which substantially fills up the inside volume of the enclosure not already occupied by the ball and brakes any movement of the ball inside said enclosure;

the maximum range of displacement of the body inside the enclosure is adjustable by means of a stop member placed inside said enclosure and provided with means to adjust its position.

The invention will be more readily understood on reading the following description with reference to the accompanying drawings in which.

Figure 1:
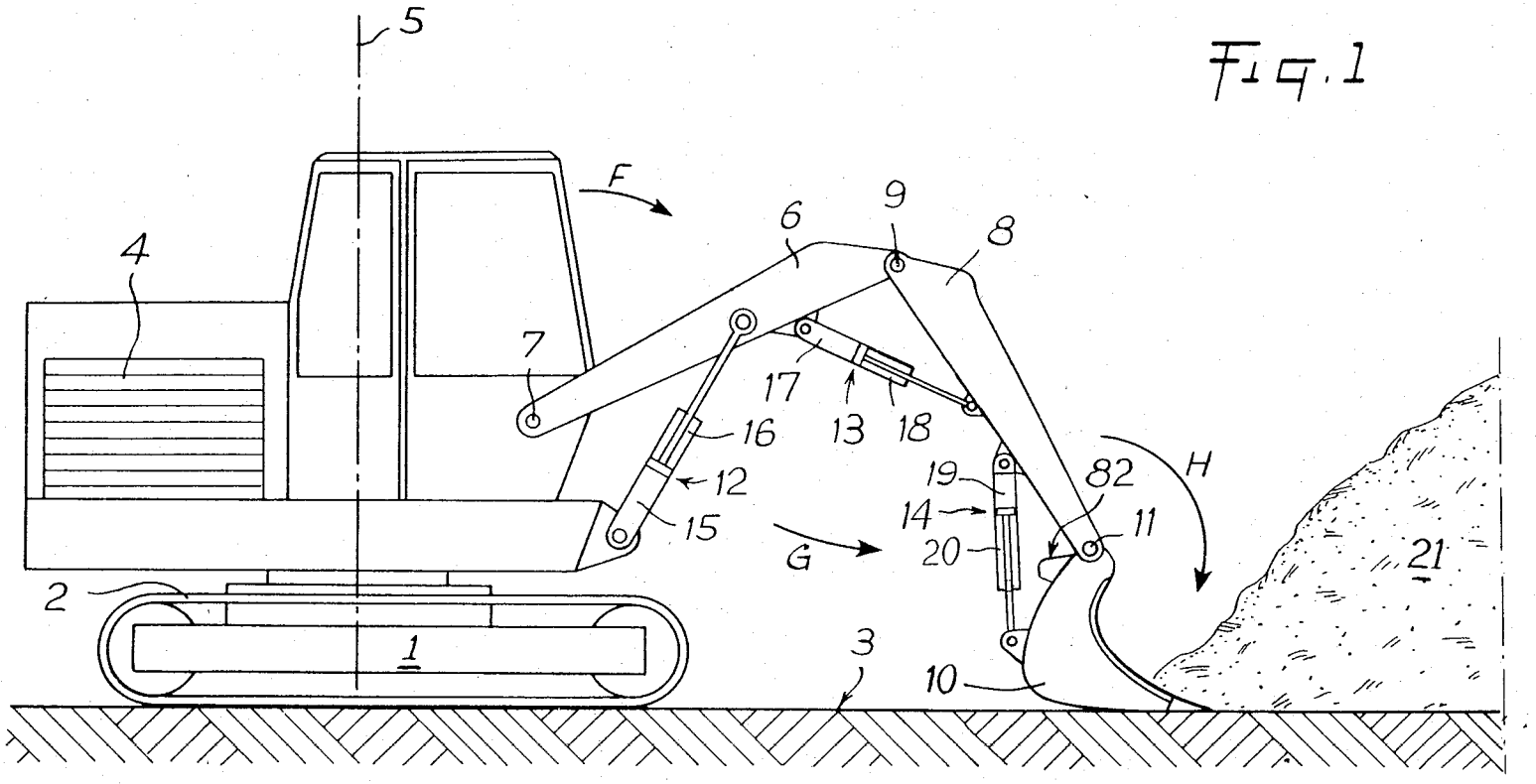
FIG. 1 is an elevational view of a machine according to the invention.

The loading machine shown in FIG. 1 comprises a chassis 1, equipped with tracks 2 by way of which it rests on the ground 3. A turret 4 is mounted for pivoting on said chassis 1, about a vertical axis 5. A boom 6 is mounted for pivoting on said turret 4 about a horizontal axis 7 whereas a dipperstick 8 is mounted for pivoting on the boom 6 about an axis 9 parallel to axis 7, and whereas a bucket 10 is mounted for pivoting on the dipperstick 8 about an axis 11 parallel to axis 7. An operating cylinder 12 is coupled between the turret 4 and the boom 6, whereas an operating cylinder 13 is coupled between the boom 6 and the dipperstick 8 and an operating cylinder 14 is coupled between the dipperstick 8 and the bucket 10.

The chambers of operating cylinders 12, 13 and 14 should be differentiated and it should be noted that:

the supply of the large chamber 15 of the boom operating cylinder 12, corresponds to the boom 6 being raised, whereas the supply of the small chamber 16 of said cylinder on the contrary corresponds to the boom 6 being lowered (arrow F);

the supply of the large chamber 17 of the dipperstick operating cylinder 13 corresponds to the extension of the dipperstick 8 ("outgoing" movement) with respect to the boom 6 (arrow G), whereas the supply of the small chamber 18 of said jack 13 on the contrary corresponds to the retraction of said stick 8 under the boom 6 (or "ingoing" movement); and, the supply of the large chamber 19 of the bucket operating cylinder 14 corresponds to a "closing up" movement of the bucket 10 with respect to the dipperstick and to the filling of said bucket, whereas the supply of the small chamber 20 of said cylinder 14 on the contrary corresponds to the "opening" of said bucket 10 with respect to said stick (arrow H) and to the emptying thereof.

Figure 3:
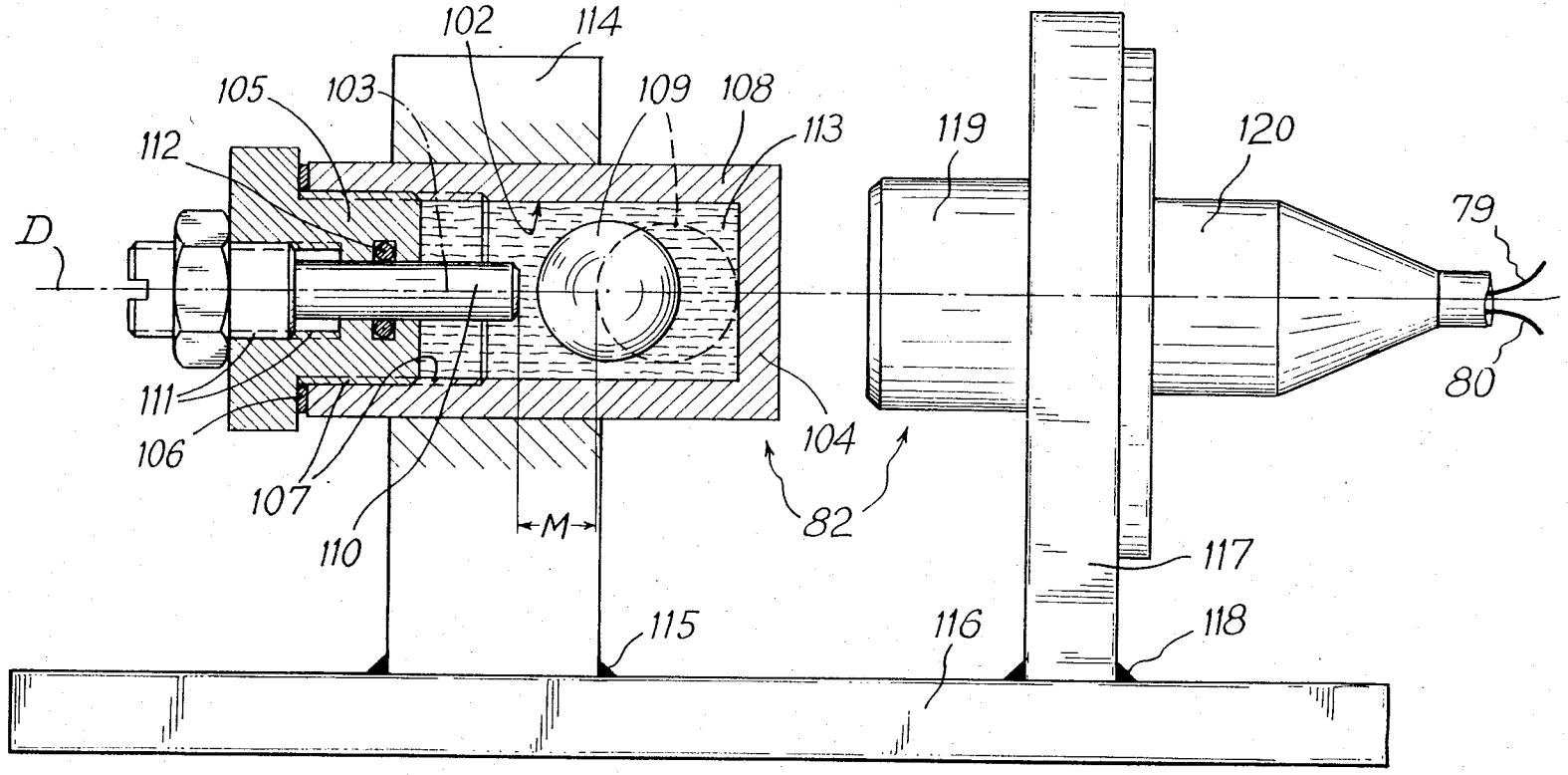
FIG. 3 is a cross-sectional view of part of a bucket orientation detector according to the invention.

Moreover, bucket 10 is illustrated in the drawing before its penetration into the heap 21 of material, and it is equipped with a detector-switch, a preferred embodiment of which is more particularly illustrated in FIG. 3.

The circuit controlling the loader comprises:

a reservoir of fluid 22, a main pump 23, connected to the reservoir 22 via its induction pipe 24, a control pump 25, connected to the reservoir 22 by its induction pipe 26, a three-position boom main control valve 27, equipped with position-adjusting operating cylinders 28 and 29, placing it respectively in its third and first positions, when they are supplied with control fluid, and a return spring 30, returning it to its second position when both cylinders 28 and 29 are not supplied with pressurized fluid, a three-position dipperstick main control valve 31, equipped with position-adjusting operating cylinders 32 and 33, placing it respectively in its third and first positions, when they are supplied with control fluid, and with a return spring 34, returning it to its second position when both cylinders 32 and 33 are not supplied with pressurized fluid, a three-position bucket main control valve 35, equipped with position-adjusting operating cylinders 36 and 37, placing it in its third and first positions when they are supplied with control fluid, and with a return spring 38, returning it to its second position when both cylinders 36 and 37 are not supplied with pressurized fluid, a control valve 39 controlling the selective supply of operating cylinders 28 and 29 of the boom main control valve 27 also with three positions, provided with an operator actuated control member such as hand lever 40, and of which the first, second and third positions correspond respectively to the first, second and third positions of the boom main control valve 27, a control valve 41 controlling the selective supply of operating cylinders 32 and 33 of the dipperstick main control valve 31, also with three positions, provided with an operator actuated control member, such as hand lever 42, and of which the first, second and third positions correspond respectively to the first, second and third positions of dipperstick main control valve 31, a control valve 43 controlling the selective supply of operating cylinders 36 and 37 of the bucket main control valve 35, also with three positions, provided with an operator actuated control member, such as hand lever 44, and of which the first, second and third positions correspond respectively to the first, second and third positions of the bucket main control valve 35, the delivery pipe 45 of the main pump 23, connected to the boom main control valve 27, a pipe 46 connecting together the main control valves of the boom 27 and dipperstick 31, a pipe 47 connecting together the main control valves of the dipperstick 31 and bucket 35, a pipe 48 connecting the bucket main control valve 35 to the reservoir 22, pipes 49 and 50 connecting the boom main control valve 27 to the raising 15 and lowering 16 chambers of the boom operating cylinder 12, respectively, pipes 51 and 52 connecting the dipperstick main control valve 31, to, respectively, the extension 17 and retraction 18 chambers of the dipperstick operating cylinder 13, pipes 53 and 54 connecting the bucket main control valve 35 to, respectively, the filling 19 and emptying 20 chambers of the bucket operating cylinder 14, pipes 55 and 56 connecting respectively operating cylinders 28 and 29 to control valve 39, pipes 57 and 58 connecting respectively operating cylinders 32 and 33 to control valve 41, a pipe 59 connecting an inlet connection 89 of a shuttle valve 87 to control valve 43, a pipe 60 connecting operating cylinder 37 to control valve 43, pipes 61, 62 and 63 connecting respectively control valves 39, 41 and 43 to reservoir 22, pipes 64, 65 and 66 connecting respectively control valves 39, 41 and 43 to the delivery pipe 67 of the control pump 25, a discharge pipe 68 connecting said delivery pipe 67 to reservoir 22, a pressure relief valve 69 placed on said discharge pipe 68 and permitting the return to the reservoir 22 of any excess fluid contained in delivery pipe 67, a pipe 70 connects the pipes 54 and 53, and is more generally designed to connect respectively the "emptying" and "filling" chambers 20 and 19 of the bucket operating cylinder 14, a restriction 71, adjustable in 72, is placed on said pipe 70, a two-position cut-off valve 73 is interposed on the pipe 70 dividing it into two sections, and, is provided, on the one hand, with a spring 74, which tends to keep it or to return it in its second position, and on the other hand, with a control cylinder 75, the effect of which is to oppose the effect of spring 74, an electrovalve 76, also with two positions, which is provided with a return spring 77 to return it to its second position, and with an electromagnet the effect of which is to oppose that of spring 77, two electric wires 79 and 80, connected to a source of electrical supply 81, the wire 79 to one (82*a*) of the terminals of a control device 82, mounted on the bucket 10, and the other wire 80 to one (78*a*) of the terminals of electrovalve 78, a third electric wire 83, connecting the other terminal (82*b*) of device 82 to the second terminal 78*b* of electromagnet 78, a pipe 84, connecting pipe 58 to electrovalve 76, a pipe 85, connecting electrovalve 76 to the control cylinder 75 of cut-off valve 73, a pipe 86, connecting electrovalve 76 to the reservoir 22, the shuttle valve 87, provided with its two inlet connections 88 and 89, and with its outlet connection 90, a pipe 91, connecting the pipe 85 to the inlet connection 88 of the shuttle valve 87, a pipe 92, connecting the outlet connection 90 of the shuttle valve 87 to the operating cylinder 36 of the bucket main control valve 35, a two-position control valve 93, placed on the pipe 84, provided with a spring 94 to return it to its second position, and a control cylinder 95, the effect of which is to oppose that of the spring, a pipe 96 connecting said cylinder 95 to the pipe 55, and, a pipe 101 connecting control valve 93 to the reservoir 22.

Figure 2:
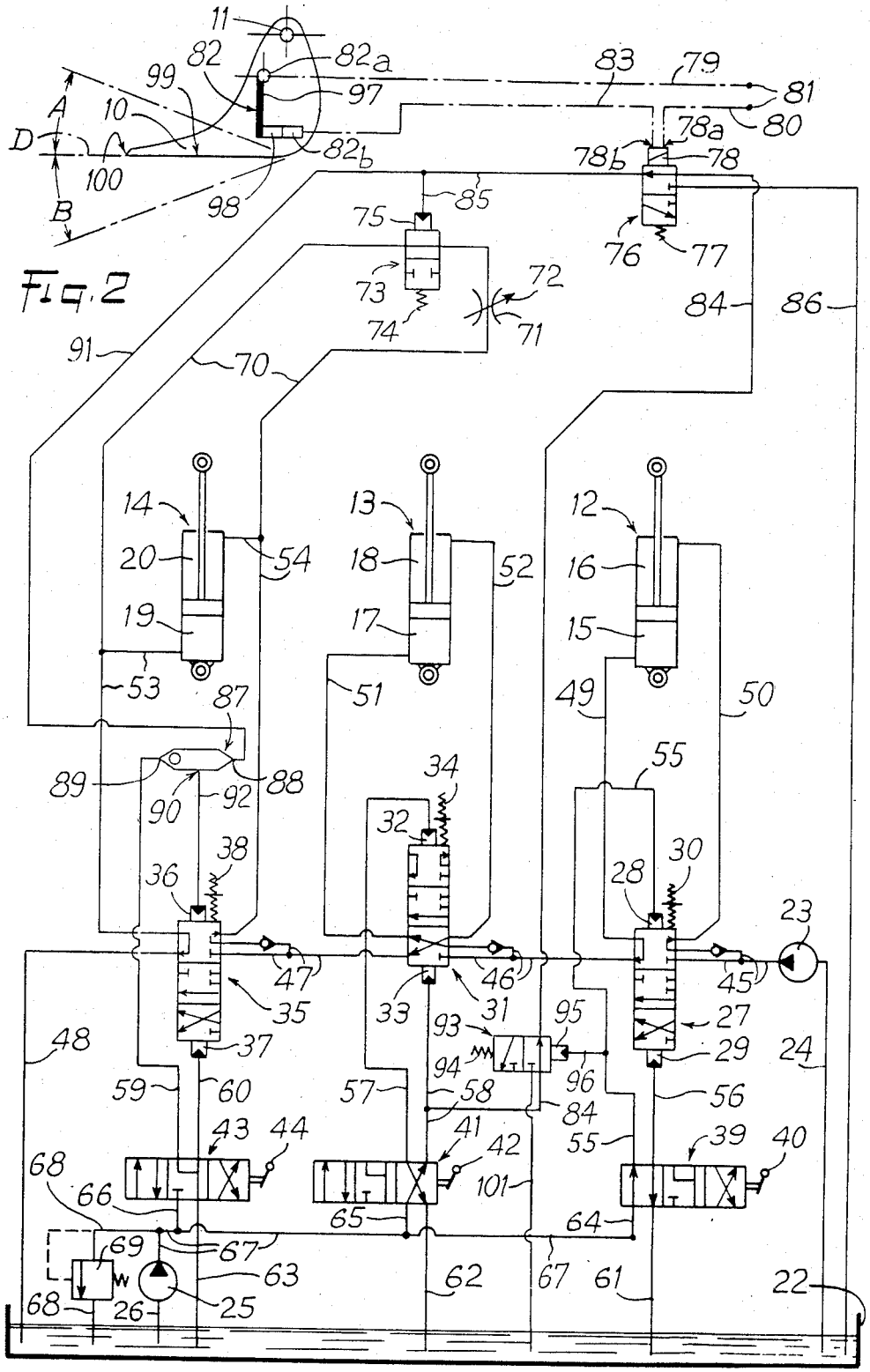
FIG. 2 is a diagram of the hydraulic circuit controlling the machine of FIG. 1.

As diagrammatically illustrated in FIG. 2, the control device 82 comprises a pendulum 97, suspended for pivoting on the bucket 10 around an axis which coincides with the terminal 82*a*, said pendulum being provided with a terminal 98 adapted to be in contact with terminal 82*b*. In the illustrated example, terminals 98 and 82*b* are in contact when the bottom 99 of the bucket 10 which extends the driving-in blade 100 of said bucket is either horizontal or forms an angle A with the horizontal D, which angle is positive with the horizontal. On the contrary, when said bottom 99 forms a negative angle B with the horizontal D, the terminals 98 and 82*b* come apart. Other devices can also give the same results as the one illustrated in the figures, and are equivalent thereto. In the illustrated example, the bottom 99 is horizontal and the terminals 98 and 82*b* are contacting. Also to be noted is the double function of device 82 which, on the one hand, detects by means of its pendulum 97, the orientation of the bottom 99 of the bucket with respect to a preset direction D, and on the other hand, makes or on the contrary breaks the contact between terminals 98 and 82*b* depending on the value of angle A or B of the bottom 99 with respect to said direction D. Moreover, although in the illustrated example, direction D is horizontal, it is obvious that, more generally, in other applications, said direction can deviate from the horizontal.

FIG. 3 shows a variant embodiment of the control device 82, which is interesting in its simplicity, its good working ability and reliability. According to said Figure, a cylindrical chamber 102, of axis 103 coinciding with direction D of the horizontal, is closed at one of its ends by a transverse base 104 and at its other end by a plug 105, which is sealed (106) and screwed (107) into the body 108 of chamber 102. A steel ball 109 is placed inside chamber 102, the free movement maximum range M of which ball is adjustable by way of a lug 110, forming stop member and projecting into the chamber 102 and screwed (111) into plug 105 which it traverses in sealed manner (112). The volume of chamber 102 which is not occupied by the ball 109 is filled with a viscous liquid 113, preferably anti-freeze. The body 108 is immobilized by a two-piece jaw, one piece only of which 114 is visible, one of the two pieces of the jaw being welded (115) on a support 116, which support is secured to the bucket 10. On said support 116, is welded (118) a securing piece 117, which securing piece holds in facing relation to the transverse base 104, the active head 119 of a sensor (120) detecting the proximity of the ball 109. When the latter is placed close to the base 104 (position shown in broken lines), the electric circuit in which the sensor 120 is fitted is closed. A fact to be noted is the connection of the wires 79 and 80 with the sensor 120. On the contrary, when the ball 109 is away from the base 104, and therefore from the active head 119, this has the effect of breaking the circuit, which then passes to the ON state. Obviously, this assembly works in exactly the same way as that shown in FIG. 2, the fluid 113 braking the movement of the ball 109 inside the chamber 102 and thus preventing possible unstabilities of operation which could cause vibrations of the bucket.

There now remains to define the positions of the different control valve assemblies.

The three positions of control valve 39 correspond:

the first position to pipe 64 communicating with pipe 56 and to pipe 55 communicating with pipe 61, the second position, to pipes 55, 56 and 61 intercommunicating, and to the obturation of pipe 64, and the third position, to pipe 64 communicating with pipe 55, and to pipe 56 communicating with pipe 61.

The three positions of the boom main control valve 27 correspond:

the first position to pipe 45 communicating with pipe 49 and to pipe 5o communicating with pipe 46, the second position to pipe 45 communicating with pipe 46, and to the obturation of pipes 49 and 50, and, the third position to pipe 45 communicating with pipe 50, and to pipe 49 communicating with pipe 46.

The three positions of control valve 41 correspond:

the first position to pipe 65 communicating with pipe 58, and to pipe 57 communicating with pipe 62, the second position to pipes 57, 58 and 62 intercommunicating and to the obturation of pipe 65, and the third position to pipe 65 communicating with pipe 57, and to pipe 58 communicating with pipe 62.

The three positions of the dipperstick main control valve 31 correspond:

the first position to pipe 52 communicating with pipe 47, and to pipe 46 communicating with pipe 51, the second position to pipe 46 communicating with pipe 47, and to the obturation of pipes 51 and 52, and, the third position to pipe 51 communicating with pipe 47, and to pipe 46 communicating with pipe 52.

The three positions of control valve 43 correspond:

the first position, to pipe 66 communicating with pipe 60, and to pipe 59 communicating with pipe 63, the second position, to pipes 59, 60 and 63 intercommunicating, and to the obturation of pipe 66, and, the third position, to pipe 66 communicating with pipe 59, and to pipe 60 communicating with pipe 63.

The three positions of the bucket main control valve 35 correspond:

the first position to pipe 47 communicating with pipe 53, and to pipe 54 communicating with pipe 48, the second position, to pipe 47 communicating with pipe 48 and the obturation of pipe 53 and 54, and the third position, to pipe 47 communicating with pipe 54 and to pipe 53 communicating with pipe 48.

The two positions of cut-off valve 73 correspond, the second position to the obturation of pipe 70 and the first position, to keeping pipe 70 open.

The two positions of electrovalve 76 correspond, the second position, to electromagnet 78 being off supply, to pipe 85 communicating with pipe 86, and to the obturation of pipe 84, and the first position, to electromagnet 78 being on electric power supply, to pipe 84 communicating with pipe 85 and to the obturation of pipe 86.

The two positions of control valve 93 correspond, the second position to the part of pipe 84 connected to electrovalve 76 communicating with pipe 101, and to the obturation of the other part of pipe 84 (connected to pipe 58), and the first position, to the preponderence of the effect of operating cylinder 95 over the spring 94, to the intercommunication of the two parts of pipe 84 and to the obturation of pipe 101.

The following dispositions should be particularly noted:

the part of pipe 84 connected to electrovalve 76 only contains a fluid under pressure when concomitantly, on the one hand, control valve 39 is placed in its third position, in which case pipe 55 contains the fluid under pressure delivered by control pump 25, and operating cylinder 95 supplied with said fluid under pressure, has placed control valve 93 in its first position, and on the other hand, control valve 41 is placed in its first position in which case pipe 58 also contains the fluid under pressure delivered by pump 25;

the two aforesaid conditions also correspond to the two following ones: concomitant positioning of the boom main control valve 27 in its third position (lowering of the boom in the direction of arrow F of FIG. 1), and of the dipperstick main control valve 31 in its first position (extension of the dipperstick main control valve 31 in its first position (extension of the dipperstick according to arrow G of FIG. 1);

when the part of pipe 84 which is connected to electrovalve 76 contains a fluid under pressure, the first and second positions of the cut-off valve 73 coincide with the first and second positions of electrovalve 76, respectively;

when on the contrary, said part of pipe 84 does not contain any fluid under pressure, whatever the position of the electrovalve 76, the cut-off valve 73 remains in its second position;

said electrovalve 76 is placed in its first position when wires 79 and 80 being connected to the source of electrical power 81, terminals 98 and **82*b* are in contact, or else, when the bottom 99** of the bucket forms a positive or nil angle A with direction D;

the bucket main control valve 35 is placed in its third position either when the control valve 43 associated thereto is itself in its third position, or when control valve 93 and electrovalve 76 are placed in their first respective positions; the fluid under pressure supplying operating cylinder 36 comes from control pump 25 and is conveyed, in the first case, through pipes 67, 66, 59, shuttle valve 87 and pipe 92, and in the second case, through pipes 67, 65, 84, 85, 91 and 92, and flows through control valve 41 placed in its first position, control valve 93 and electrovalve 76 placed in their respective first positions, and shuttle valve 87;

in the diagram shown in FIG. 2, the control valves, cut-off valves and electrovalve are in the following positions;

control valve 39 and boom main control valve 27 in their respective third positions, corresponding to the lowering of boom 6 (arrow F in FIG. 1);

control valve 41 and dipperstick main control valve 31 in their respective first positions, corresponding to the extension of the dipperstick 8 (arrow G in FIG. 1);

control valve 43 in its second position, but the bucket main control valve 35 which corresponds to said control valve 43, in its third position due to the concomitance of the third position of the boom main control valve 39, first position of the dipperstick main control valve, 41, and first positions of the control valve 93 and electrovalve 76;

cut-off valve 73 in its first position;

the orientation of bucket 10 is adjusted, prior to the movement which is about to be described, by operating control valve 43 so that said bucket is placed as shown in FIG. 1, ready to penetrate into the heap of material 21, its bottom 99 being oriented substantially in parallel to direction D.

The movement operated has a known aspect and a novel aspect. The known aspect consists in compensating for the raising of the bucket 10 caused by the extension of the dipperstick 8, by lowering the boom 6.

The novel aspect consists in automatically controlling the "opening" of the bucket 10 (bucket-emptying movement according to arrow H), and thus in compensating for the variation in the orientation of the bucket caused by the pivoting movements of the boom and dipperstick, by varying the orientation of said bucket, of an absolute value equal to the first one, but of opposite sign, and in this way, keeping the orientation of the bucket constant with respect to the ground 3, (or more generally with respect to direction D), this being important to ensure a good penetration into the heap of material 21. Naturally, the compensation also takes into account the small variation of the orientation of the bucket caused by the pivoting movement of the boom, so that, overall, the orientation of the bucket with respect to the ground 3 remains constant.

The material means to achieve this compensation consists, when the boom 6 is being lowered and the dipperstick 8 is being extended, in automatically controlling the bucket 10-emptying movement. This is effectively achieved with the system described, according to which, to the positioning of the boom and dipperstick main control valves 27 and 31 in their third and first positions respectively, generally corresponds to the automatic positioning of the bucket main control valve 35 in its third position, a general automatic positioning which is however neutralized in the configuration described hereinafter.

In effect, the aforementioned correspondence between the positions is always achieved, except when electrovalve 76 is in its second position. This last case occurs when terminals 98 and 82*b* are apart, i.e. when the orientation of the bucket 10 is such that its bottom 99 forms a negative angle B with direction D, i.e. here with the horizontal. There is then a risk of the bucket emptying and it becomes necessary, not to aggravate this risk by continuing to empty the bucket, but on the contrary, to reduce it by cutting off momentarily the control of the emptying of the bucket until the bottom 99 has become once again parallel to direction D by the combined effects of the boom lowering and stick extending pivoting movements. And it is precisely the main function of the device 82 to ensure this momentary interruption in the automatic control of the emptying of the bucket 10.

When the bucket main control valve 35 is effectively placed automatically in its third position, the fluid under pressure contained in pipe 47 is directed towards pipes 54 and 70. The value of restriction 71 is adjusted so that the adequate pressure is set up in the emptying chamber 20 of the bucket operating cylinder 14 in order that an emptying rotation (arrow H) is effectively performed. The excess fluid returns to the reservoir 22 by traversing the cut-off valve 73 and the bucket control valve 35, via pipes 70, 53 and 48.

Obviously, it has also been necessary to arrange for the spontaneous emptying of the bucket to be controlled by means of control valve 43. Were the cut-off valve 73 not provided, part of the fluid under pressure supplying the chamber 20 would leak out through the restriction 71. To prevent this loss, which is unnecessary, the pipe 70 in this case had to be closed off. And this is the function of the cut-off valve 73 which, in the configuration of operator actuated emptying, is once again in its second position. Indeed, in this configuration, the boom 6 at least has stopped going down, on the contrary even, so that control valve 93 is replaced in its second position in which the fluid contained in the cylinder 75 operating the cut-off valve 73, is communicating with reservoir 22, either via pipes 84 and 101, or via pipe 86, depending on the position of electrovalve 76.

Finally, the proposed system will be noted for its simplicity, said system needing no other sources of fluid under pressure (pumps 23 and 25) but the already existing ones, and enables, owing to the shuttle valve 87, to automatically switch the positioning controls of the bucket main control valve 35 to its third position, either activation by the operator (via control valve 43, or automatically (via control valve 93 and electrovalve 76).

The new disposition is not designed to replace the conventional one which is retained (and independently controlled operating cylinder for each one of elements: boom, dipperstick, bucket), but merely completes it.

The invention is in no way limited to the embodiment described hereinabove and on the contrary covers any variant that can be brought thereto without departing from its scope or its spirit.

In particular, the following dispositions have also been proposed under the claimed disposition:

- the members used for adjusting the pivoting movement of the boom 6, of the dipperstick 8 and of the bucket 10, which in the foregoing embodiment, are linear hydraulic cylinders 12, 13 and 14, could be constituted by electric motors, by rotary operating cylinders, or by other equivalent members;
- likewise, the operating cylinders used for adjusting the positions of the main control valves 28, 29, 32, 33, 36 and 37, which are of a hydraulic type in the foregoing embodiment, can be replaced by electromagnets or like elements;
- when, for example, control electromagnets are used, the control valve 93 and electrovalve 76 are advantageously replaced by electric switches;
- in any case, even in the essentially hydraulic embodiment described hereinabove, it is clear that pipes 84 and 96, could have been connected respectively, to pipes 55 and 58 instead of the reverse, without the overall operation being affected;
- finally, and even in the illustrated embodiment, the communication of the part of pipe 84 connected with the electrovalve 76, with a source of fluid under pressure, which is controlled by control valve 93, could have been achieved, on the one hand, from a source of fluid under pressure other than the fluid contained in pipe 58, and for example by an independent source, on the other hand, by an adjustment of the position of the control valve 93 other than by operating cylinder 95, and for example, by an adjustment by direct mechanical coupling of said control valve 93 to the main control valves 27 and 31.

What we claim is:

1. An earth-moving machine of the loading type, having a frame, a boom mounted for pivoting with respect to said frame, a dipperstick mounted for pivoting with respect to said boom, a bucket for loading the material, mounted for pivoting with respect to the stick, a double-acting boom member controlling the relative pivoting movement of the boom with respect to the frame coupled between the boom and frame and comprising two supply connections for respectively "raising" and "lowering" the boom, a double-acting stick member controlling the relative pivoting movement of the dipperstick with respect to the boom coupled between these two elements and comprising two supply connections for respectively "extending" and "retracting" the stick, a double-acting bucket member to adjust the relative pivoting movement of the bucket with respect to the dipperstick, coupled between these two elements and comprising two supply connections for respectively "filling" and "emptying" the bucket, at least one source of power, a three-position boom main control valve connected via three separate connections to a source of power and to the said boom "raising" and "lowering" connections, said boom main control valve connecting the said source of power, in its first position, with the boom raising connection, in its third position with the boom lowering connection, and in its second position, isolating said source of power from said connections, a three-position dipperstick main control valve connected by three separate connections with a source of power and with the stick- "extending" and "retracting" connections, said dipperstick main control valve connecting said source of power, in its first position, with the stick-extending connection, in its third position with the stick-retracting connection, and in its second position, isolating said two connections from said source of power, and a three-position bucket main control valve connected by three separate connections with a source of power and with the bucket "filling" and "emptying" connections, said bucket main control valve connecting said source of power, in its first position, with the bucket filling connection, in its third position, with the bucket emptying connection, and, in its second position, isolating said connections from said source of power, and said bucket main control valve being provided with a first means to adjust its position, said means being adapted to place said control valve in any one of its three positions be direct actuation by the machine operator, the bucket main control valve having second means to adjust its position adapted to place said bucket main control valve in its third position automatically from its second position, and being to this effect connected to a source of power by a control connection, an auxiliary control valve assembly with at least two positions being interposed on said control connection to ensure its continuity on either of its sides in its first position and break off said connection in its other positions, the auxiliary control valve assembly being placed in its first position solely when the boom and stick main control valves are in their third and first positions respectively and wherein in the first position of said auxiliary control valve assembly, the second means for adjusting the position of the bucket main control valve, effectively connected with the source of power, places said bucket main control valve in its third position.

2. A machine as claimed in claim 1, wherein a bucket orientation-limiting member is placed on said control connection and can assume either of two positions, in the first one of which it causes the two parts of said control connection connected thereto to communicate, and in the second position wherein it isolates said two parts, the machine including means to adjust the position of said orientation-limiting member associated with a detector of the relative position of the bucket with respect to a predetermined direction and with a switch, connected to said detector and designed to control the said means provided to adjust the position of the bucket orientation-limiting member, in order to place said bucket orientation limiting member in its second position, when the detected orientation of the bucket exceeds a preset valve thereof.

3. A machine as claimed in claim 1, wherein the source of power associated to the bucket main control valve is a source of pressurized fluid, a fluid excess pipe connecting the discharge pipe of the double-acting member to adjust the relative pivoting movement of the bucket with a non-pressurized reservoir, and a restriction and a cut-off valve being provided on said excess fluid pipe, said cut-off valve having two positions, one in which it causes the two parts of said excess fluid pipe connected thereto to communicate, and the other in which it closes off said communication, means to adjust the position of said cut-off valve connected in parallel to said source of power to which is connected the said second means to adjust the position of the bucket main control valve, and, the cut-off valve being placed, in its first position, when said second adjusting means are effectively connected with said source of power, and, in its second position, when said second adjusting means are isolated from said source of power.

4. A machine as claimed in claim 2, wherein the source of power associated with the bucket main control valve is a source of pressurized fluid, a fluid excess pipe connecting the discharge pipe of the double acting member provided to adjust the relative pivoting movement of the bucket with a non-pressurized reservoir, and a restriction and a cut-off valve are placed on said excess fluid pipe, said cut-off valve having two positions, one in which it causes the two parts of said excess fluid pipe connected thereto to communicate, and the other in which it closes off said communication, means to adjust the position of said cut-off valve connected in parallel to said source of power to which is connected the said second means to adjust the position of the bucket main control valve, and, the cut-off valve being placed, in its first position, when said second adjusting means are effectively connected with said source of power, and, in its second position, when said second adjusting means are isolated from said source of power.

5. Machine as claimed in one of claims 1 to 4, wherein said machine comprises a shuttle valve with two inlet connections and one outlet connection, whereas the first and second means are provided to adjust the position of the bucket main control valve are constituted by a single fluid cylinder connected by way of a pipe to said outlet connection, an operator actuated control pipe connecting one of said inlet connection with a three-position bucket control valve, said three positions corresponding to the three positions of the bucket main control valve, said bucket control valve being itself connected with a source of fluid under pressure, and, an automatic control pipe connecting the other of said inlet connection of the shuttle valve with the said source of power to which is connected the second means to adjust the position of the bucket main control valve, this last source of power being also a source of fluid under pressure.

6. Machine as claimed in claim 2, wherein the detector of the relative orientation of the bucket with respect to a predetermined direction is an assembly constituted by a support and a horizontality sensor fitted on said support and comprising an enclosure containing a substantially freely movable member, and, a proximity sensor, also fitted on the support, adjacent to a wall defining said enclosure and capable of detecting the proximity of the body to said proximity sensor, and then, of changing the state of an electric circuit in which it is integrated, and which passes from one of the ON- or OFF- states to a complementary OFF or ON state.

7. Machine as claimed in claim 6, wherein the substantially freely movable body is a metal ball.

8. Machine as claimed in claim 7, wherein the enclosure also contains a viscous liquid, which substantially fills up the inside volume of the enclosure not already occupied by the ball and brakes any movement of the ball inside said enclosure.

9. Machine as claimed in one of claims 6 to 8, wherein the maximum range of displacement of the body inside the enclosure is adjustable by means of a stop member placed inside said enclosure and provided with means to adjust its position.

* * * * *